US010429120B2

(12) United States Patent
Han et al.

(10) Patent No.: US 10,429,120 B2
(45) Date of Patent: Oct. 1, 2019

(54) REFRIGERATOR

(71) Applicant: LG Electronics Inc., Seoul (KR)

(72) Inventors: Tackwon Han, Seoul (KR); Junsoo Han, Seoul (KR)

(73) Assignee: LG Electronics Inc., Seoul (KR)

( * ) Notice: Subject to any disclaimer, the term of this patent is extended or adjusted under 35 U.S.C. 154(b) by 46 days.

(21) Appl. No.: 15/749,264

(22) PCT Filed: Nov. 8, 2016

(86) PCT No.: PCT/KR2016/012776

§ 371 (c)(1),
(2) Date: Jan. 31, 2018

(87) PCT Pub. No.: WO2017/099367

PCT Pub. Date: Jun. 15, 2017

(65) Prior Publication Data

US 2018/0224187 A1 Aug. 9, 2018

(30) Foreign Application Priority Data

Dec. 11, 2015 (KR) ..... 10-2015-0176797

(51) Int. Cl.
*F25D 17/06* (2006.01)
*F25D 25/02* (2006.01)
*F25D 23/06* (2006.01)

(52) U.S. Cl.
CPC ..... *F25D 17/065* (2013.01); *F25D 23/069* (2013.01); *F25D 25/025* (2013.01);
(Continued)

(58) Field of Classification Search
CPC ..... F25D 17/065; F25D 17/08; F25D 17/067; F25D 17/045; F25D 17/062;
(Continued)

(56) References Cited

U.S. PATENT DOCUMENTS 9,441,873 B1 * 9/2016 Drach ..... E06B 3/325
2007/0151281 A1 * 7/2007 Jackovin ..... F25D 11/02 62/344

(Continued)

FOREIGN PATENT DOCUMENTS

JP 8033272 A 2/1996
JP 2014122746 A 7/2014

(Continued)

OTHER PUBLICATIONS

Extended European Search Report in European Appln. No. 16873233.7, dated Feb. 5, 2019, 10 pages.

(Continued)

*Primary Examiner* — Emmanuel E Duke
(74) *Attorney, Agent, or Firm* — Fish & Richardson P.C.

(57) ABSTRACT

Disclosed is a refrigerator including a cabinet, a storage compartment provided in the cabinet to form a single space in which a storage item is stored, a single door for opening or closing the space formed by the storage compartment, a first cold air supply duct and a second cold air supply duct provided respectively on left and right sides of the single storage compartment, the first cold air supply duct and the second cold air supply duct supplying different amounts of cold air, and a storage unit for being pushed into or pulled from the storage compartment in a front-and-rear direction along with the door.

20 Claims, 10 Drawing Sheets

(52) U.S. Cl.
CPC .. *F25D 2317/061* (2013.01); *F25D 2317/067* (2013.01); *F25D 2700/121* (2013.01)

(58) Field of Classification Search
CPC ..... F25D 23/069; F25D 25/025; F25D 2317/067; F25D 2317/065; F25D 2317/0683; F25D 2317/0662; F25D 2317/061; F25D 2700/121; F24D 11/022
See application file for complete search history.

(56) References Cited

U.S. PATENT DOCUMENTS

2007/0163282 A1* 7/2007 Cushman ..... F25D 17/065 62/340
2008/0271475 A1* 11/2008 Wuesthoff ..... F25D 17/065 62/447
2008/0302125 A1* 12/2008 Cushman ..... F25D 17/065 62/408
2010/0175403 A1* 7/2010 Kim ..... F25D 17/065 62/231
2010/0218514 A1* 9/2010 Bertolini ..... F25D 17/065 62/56
2011/0259036 A1* 10/2011 Lim ..... F25C 1/24 62/344
2015/0059399 A1* 3/2015 Hwang ..... F25D 11/02 62/441

FOREIGN PATENT DOCUMENTS

KR 2001010883 A 2/2001
KR 20010010883 A * 2/2001 ..... F25D 17/065
KR 2001070834 A 7/2001
KR 2006041500 A 5/2006
KR 2015027979 A 3/2015
WO W02012076487 6/2012

OTHER PUBLICATIONS

International Search Report and Written Opinion in International Application No. PCT/KR2016/012776, dated Jan. 3, 2017, 19 pages.

* cited by examiner

[Fig. 1]
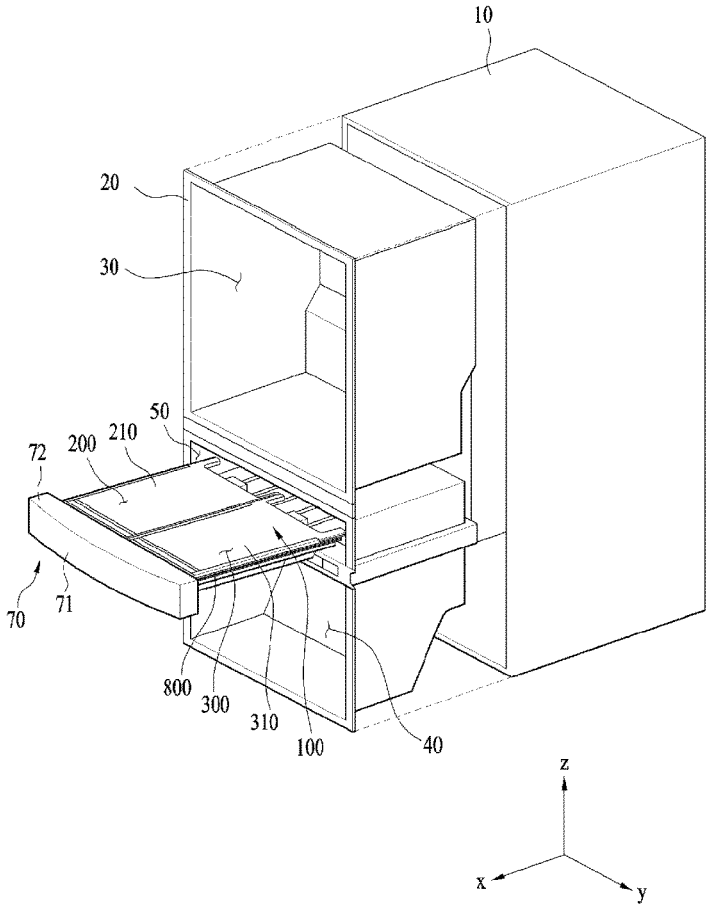
[Fig. 2]
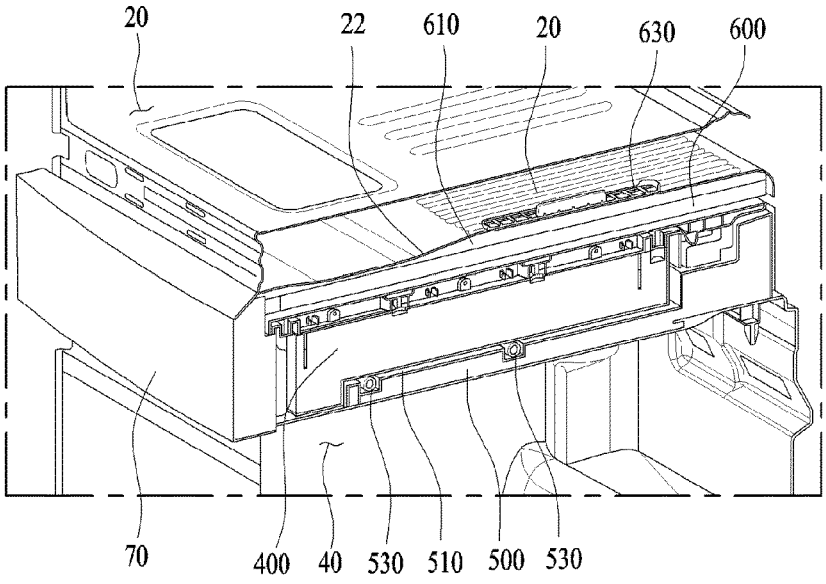

[Fig. 3]
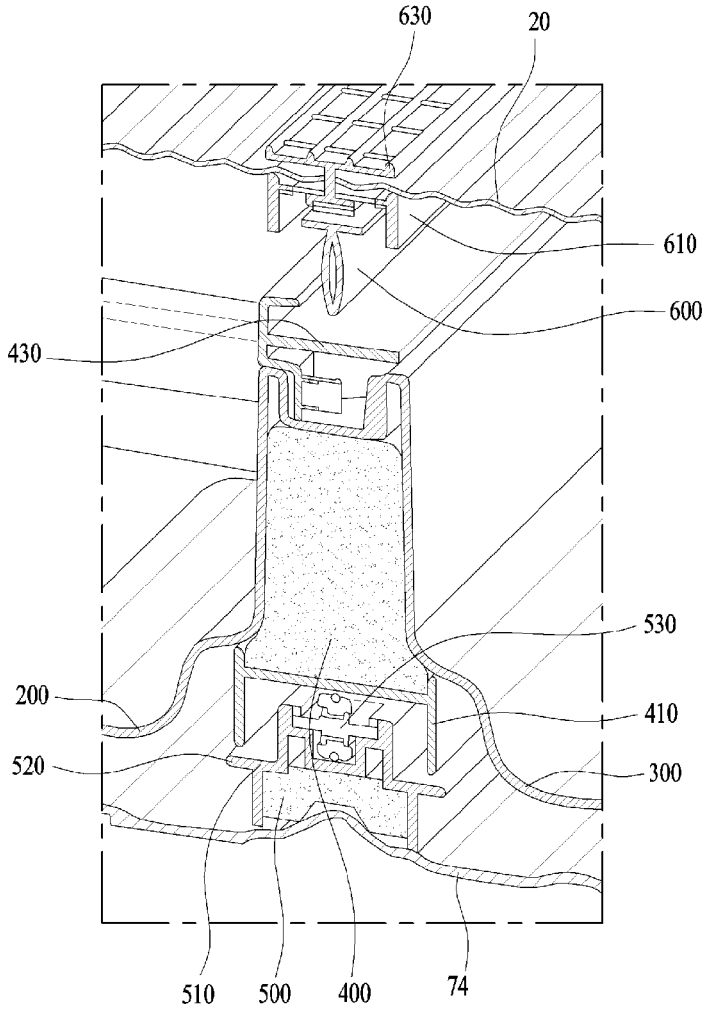

[Fig. 4]
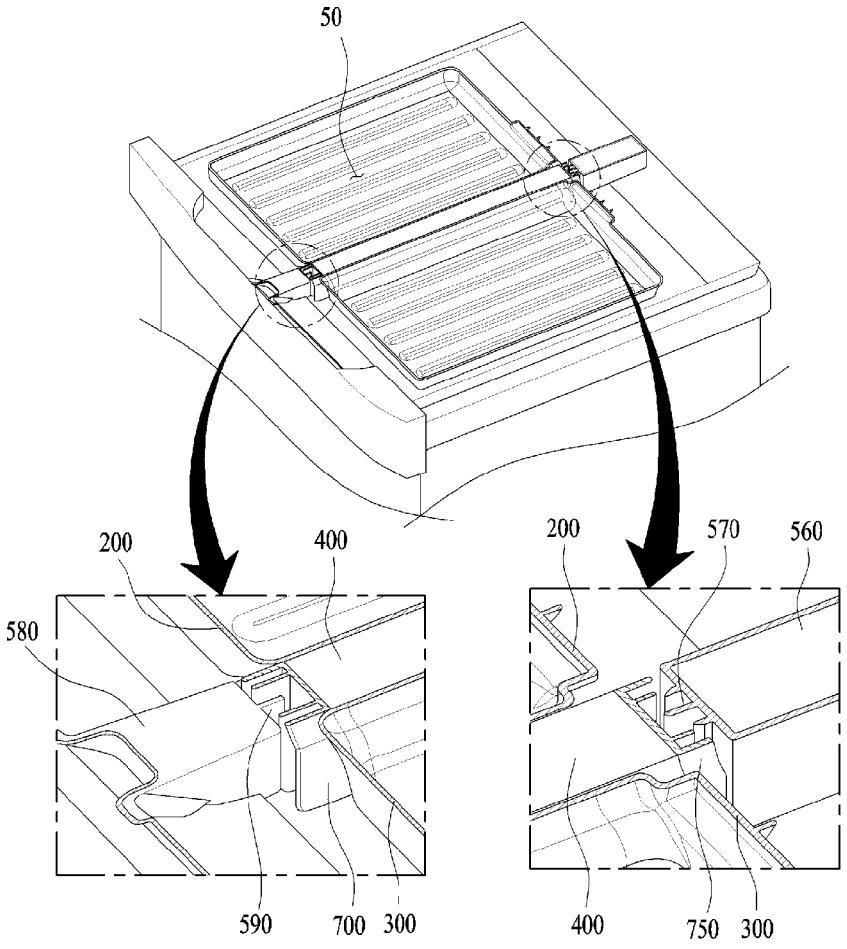

[Fig. 5]
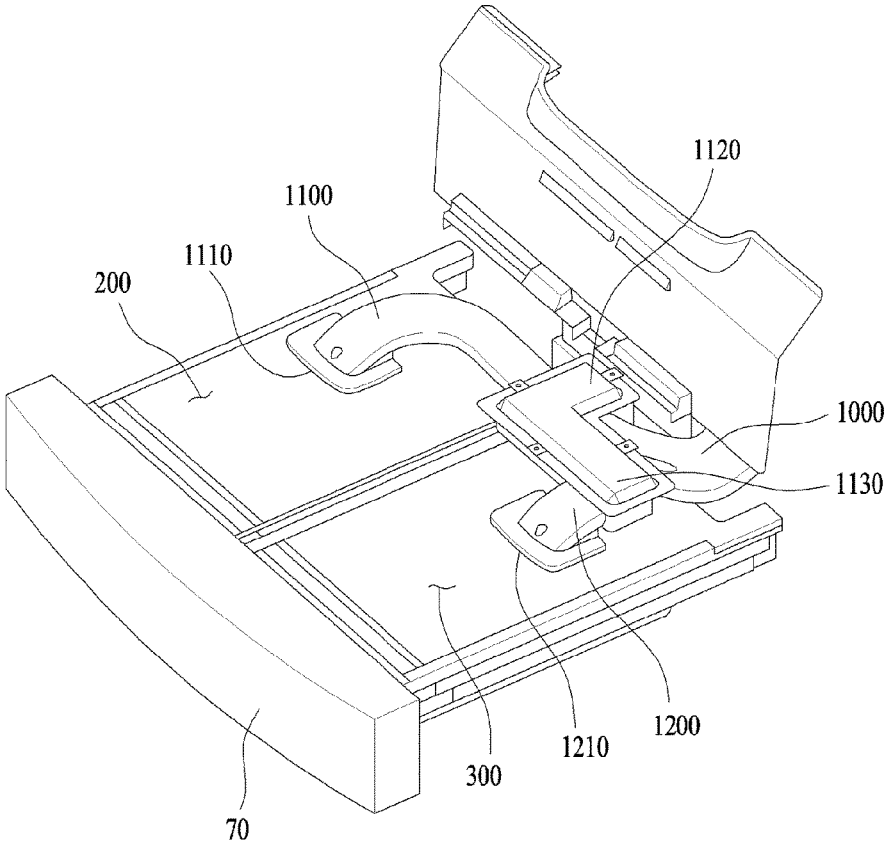

[Fig. 6]
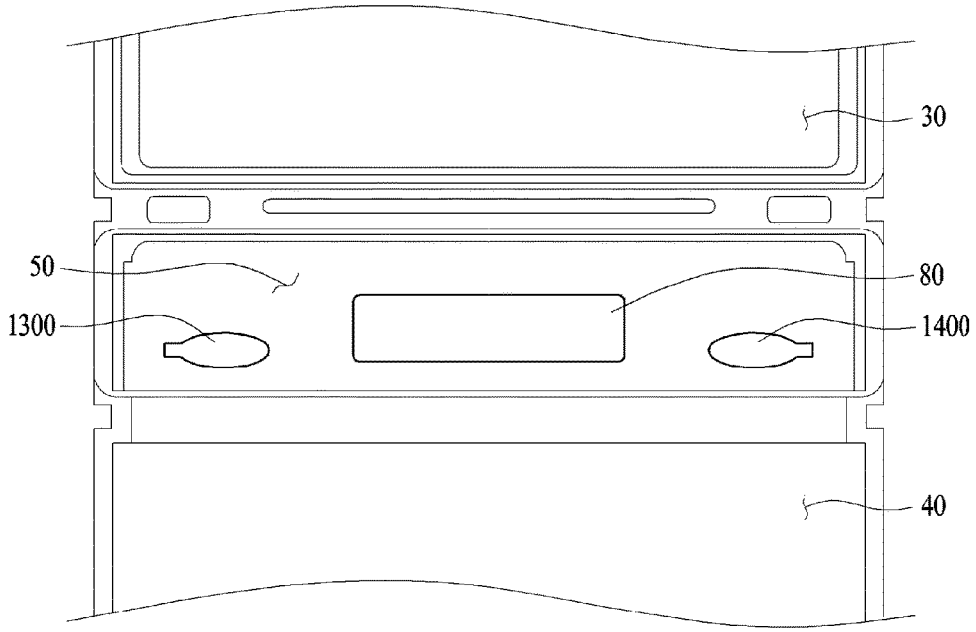
[Fig. 7]
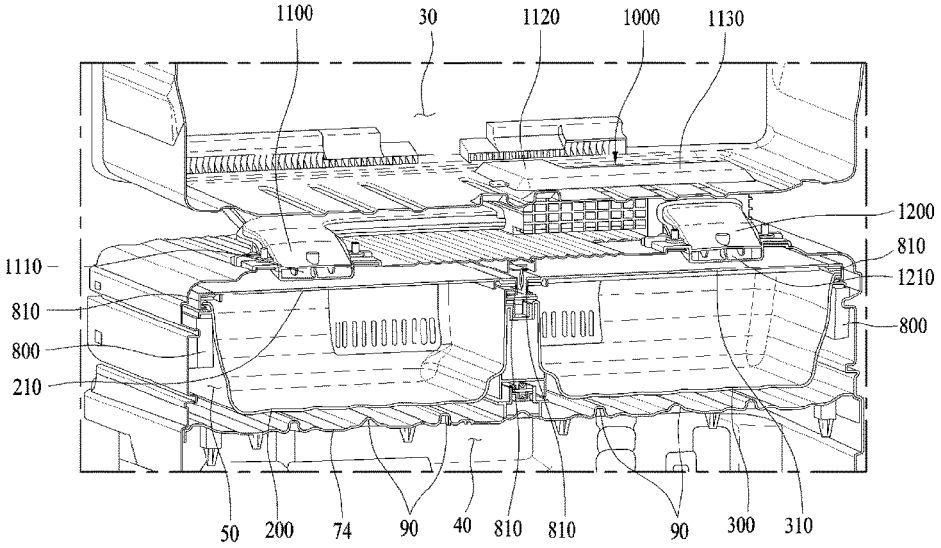

[Fig. 8]
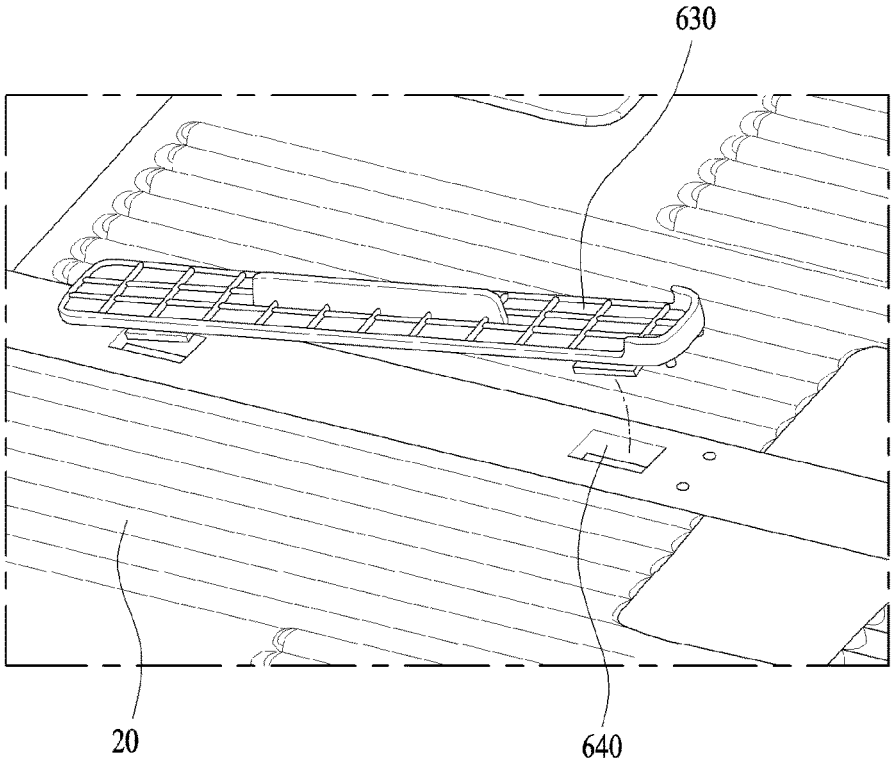
[Fig. 9]
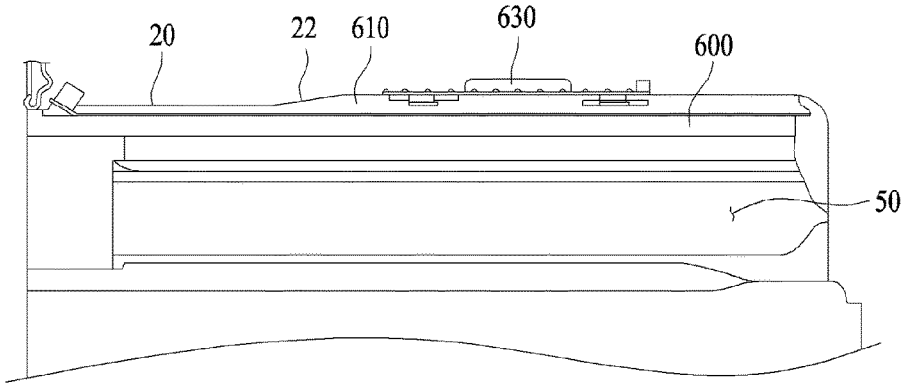

[Fig. 10]
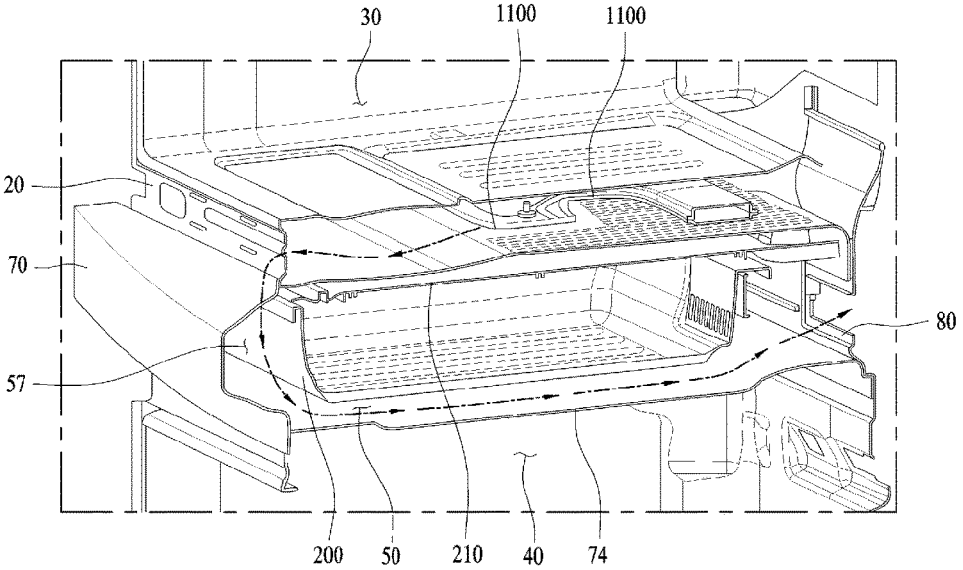
[Fig. 11]
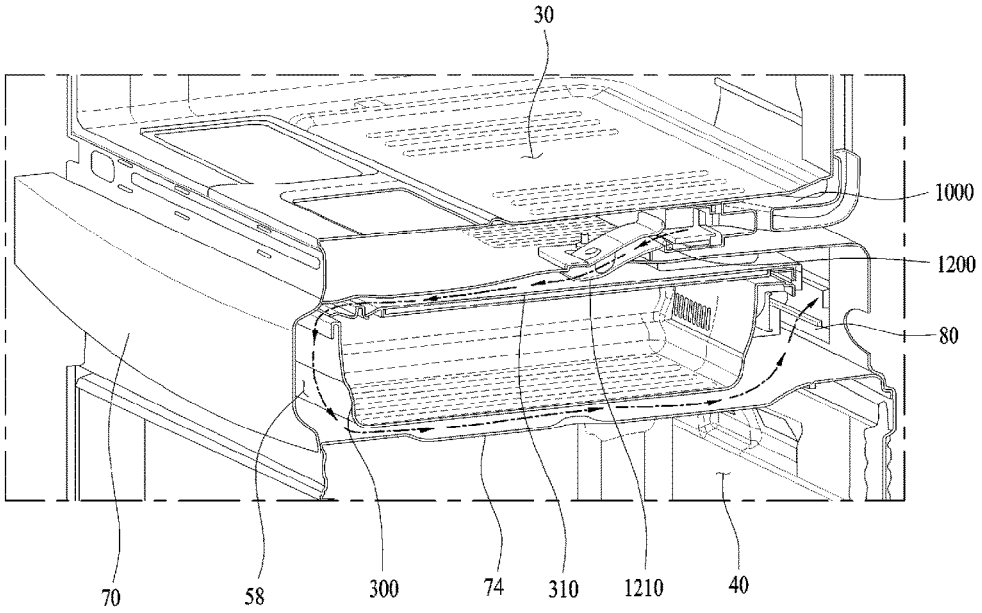

[Fig. 12]
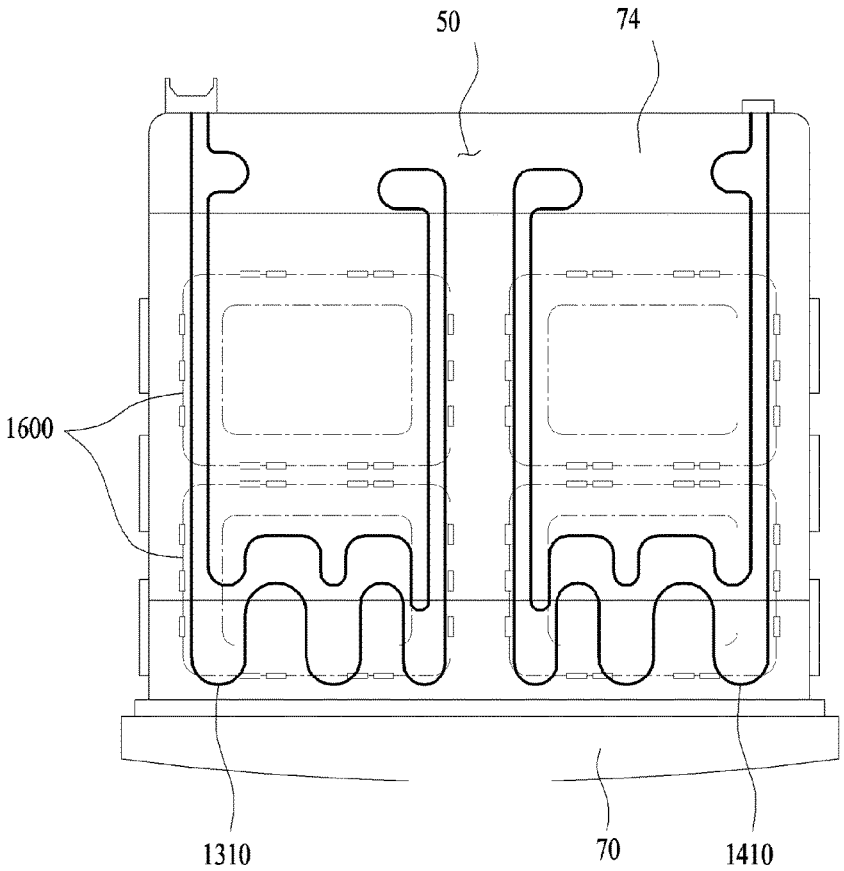
[Fig. 13A]
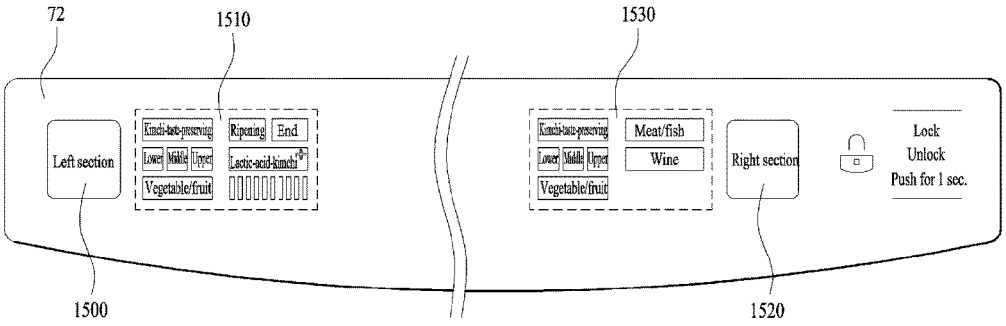

[Fig. 13B]

| Mode | Sort | Temperature |
|---|---|---|
| Kimchi-taste-preserving | Lower | 1.0 |
| | Middle | -1.5 |
| | Upper | -2.0 |
| Vegetable/fruit | Lower | -2.5 |
| | Middle | 3.5 |
| | Upper | 4.5 |
| Ripening | - | 4.5 |
| Lactic-acid-kimchi | - | 6.5 |

[Fig. 13C]

| Mode | Sort | Temperature |
|---|---|---|
| Meat/fish | - | -2.5 |
| Kimchi-taste-preserving | Lower | -1.0 |
| | Middle | -1.5 |
| | Upper | -2.0 |
| Vegetable/fruit | Lower | 2.5 |
| | Middle | 3.5 |
| | Upper | 4.5 |
| Wine | - | 5.0 |

[Fig. 14]
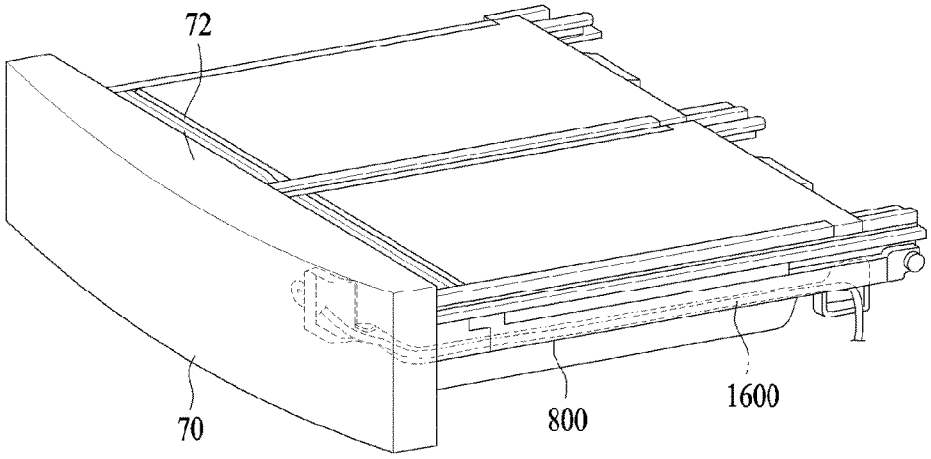
[Fig. 15]
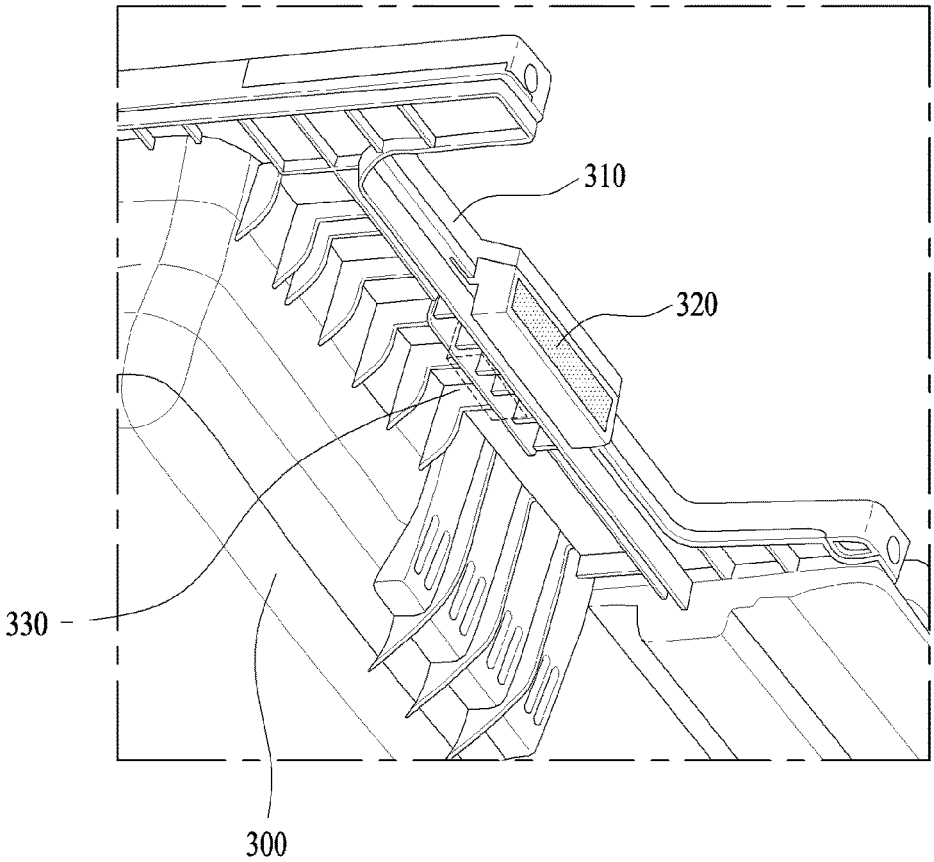

REFRIGERATOR

CROSS-REFERENCE TO RELATED APPLICATIONS

This application is a National Stage application under 35 U.S.C. § 371 of International Application No. PCT/KR2016/012776, filed on Nov. 8, 2016, which claims the benefit of Korean Patent Application No. 10-2015-0176797, filed on Dec. 11, 2015. The disclosures of the prior applications are incorporated by reference in their entirety.

TECHNICAL FIELD

The present invention relates to a refrigerator, and more particularly, to a refrigerator, which may provide a plurality of storage spaces, maintained at different temperatures, within a single storage compartment.

BACKGROUND ART

Generally, a refrigerator includes a machine room in the lower region of a main body. The machine room is generally installed in the lower region of the refrigerator in consideration of the center of gravity of the refrigerator, the efficiency of assembly, and a reduction in vibrations.

The machine room of the refrigerator is provided with a refrigeration cycle device. The refrigeration cycle device maintains the inside of the refrigerator in a refrigerated/freezing state using the property of refrigerant, whereby outside heat is absorbed while changing from a low-pressure liquid phase into a gas phase, thereby allowing the refrigerator to keep food fresh.

The refrigeration cycle device of the refrigerator includes, for example, a compressor, which changes low-temperature and low-pressure gas-phase refrigerant into high-temperature and high-pressure gas-phase refrigerant, a condenser, which changes the high-temperature and high-pressure gas-phase refrigerant from the compressor into low-temperature and high-pressure liquid-phase refrigerant, and an evaporator, which changes the low-temperature and high-pressure liquid-phase refrigerant from the condenser into gas-phase refrigerant, thus absorbing outside heat.

The refrigerator includes a plurality of storage compartments separated from each other, and each storage compartment is maintained at the same temperature based on a single control temperature. In particular, the storage compartment that is intended to serve as a refrigerating compartment is controlled so as to be limited to the range of temperatures that may be provided in the refrigerating compartment, and the storage compartment that is intended to serve as a freezing compartment is controlled so as to be limited to the range of temperatures that may be provided in the freezing compartment.

Therefore, it may be difficult to store different items, which require different storage temperatures, within a single storage compartment having a wide space therein.

DISCLOSURE OF INVENTION

Technical Problem

Therefore, the present invention has been made in view of the above problems, and one object of the present invention is to provide a refrigerator, which may provide a plurality of storage spaces, maintained at different temperatures, within a single storage compartment.

In addition, another object of the present invention is to provide a refrigerator, which may control the temperatures of a plurality of storage spaces so that the respective storage spaces may be used to ripen or store kimchi.

In addition, a further object of the present invention is to provide a refrigerator, in which two storage units separated from each other are arranged within a storage compartment so as to allow a user to easily recognize the control temperatures of the respective storage units.

Solution to Problem

In accordance with an aspect of the present invention, the above and other objects can be accomplished by the provision of a refrigerator including a cabinet, a storage compartment provided in the cabinet to form a single space in which a storage item is stored; a single door for opening or closing the space formed by the storage compartment, a first cold air supply duct and a second cold air supply duct provided respectively on left and right sides of the single storage compartment, the first cold air supply duct and the second cold air supply duct supplying different amounts of cold air, and a storage unit for being pushed into or pulled from the storage compartment in a front-and-rear direction along with the door, wherein the storage unit includes a first storage unit provided on the left side, a second storage unit provided on the right side, an insulator located between the first storage unit and the second storage unit for separating the first storage unit and the second storage unit from each other, a first cover for opening or closing an opening formed in an upper side of the first storage unit, and a second cover for opening or closing an opening formed in an upper side of the second storage unit, the second cover being movable separately from the first cover, and wherein the first storage unit and the second storage unit are maintained at different temperatures.

The refrigerator may keep food, which needs to be organized and stored at different temperatures, as the result of dividing the single storage compartment into several separated spaces.

The storage compartment may define therein the single space, to which the cold air supplied from the first cold air supply duct and the second cold air supply duct moves.

The insulator may have a greater thickness than a thickness of a wall of the first storage unit or the second storage unit.

The storage compartment may include an insulating partition located below the insulator.

The insulating partition may include a roller for supporting a bottom of the insulator so that the insulator is movable.

The refrigerator may further include a housing for accommodating the insulating partition, and the housing may include a rib protruding from an outer circumferential surface thereof.

The insulator may include a rib that extends downward.

The storage compartment may include a gasket located above the insulator.

The gasket may extend downward from a ceiling of the storage compartment.

The insulator may be provided with a first protruding piece on a surface thereof facing the door, and the first protruding piece may extend toward the door so as to prevent movement of air between the left side and the right side within the storage compartment.

The insulator may be provided with a second protruding piece on a surface thereof facing an inside of the storage compartment, and wherein the second protruding piece may extend toward the inside of the storage compartment so as to prevent movement of air between the left side and the right side within the storage compartment.

The first cold air supply duct and the second cold air supply duct may be located on an upper side of the storage compartment so as to discharge the cold air downward.

The first cold air supply duct and the second cold air supply duct may have respective outlet ports, each located at a center in a front-and-rear length of the storage compartment.

The storage compartment may be provided in a rear surface thereof with a discharge opening for discharging air inside the storage compartment to an outside.

The discharge opening may be located at a center in a left-and-right length of the rear surface.

All air in the left side and the right side of the storage compartment may be discharged through the discharge opening.

The refrigerator may further include a temperature sensor for measuring a temperature in the storage compartment, and the temperature sensor may be located at a position spaced apart from the discharge opening.

The temperature sensor may include a first temperature sensor for measuring a temperature in a left space of the storage compartment, and a second temperature sensor for measuring a temperature in a right space of the storage compartment.

The first temperature sensor and the second temperature sensor may be located at symmetrical positions about the discharge opening.

The storage compartment may include a guide rib formed on a bottom surface thereof so as to extend a long length in a front-and-rear direction of the storage compartment.

The storage compartment may be provided in a ceiling wall thereof with a through-hole, the storage compartment may include a gasket located above the insulator, and the storage compartment may be provided on an exterior of the ceiling wall with a fixing member that fixes the gasket through the through-hole.

The ceiling wall may be provided with a slope, which is inclined relative to a horizontal plane, the gasket may be provided at an upper side thereof with a gasket housing that comes into surface contact with the slope, and the gasket housing may extend a long length in a front-and-rear direction of the storage compartment.

The door and the first storage unit may define a first space therebetween so that the cold air discharged from the first cold air supply duct passes through the first space.

The door and the second storage unit may define a second space therebetween so that the cold air discharged from the second cold air supply duct passes through the second space.

The first storage unit and the second storage unit may be located so as to be spaced apart from a bottom surface of the storage compartment.

The storage compartment may be provided in a bottom thereof with a first heater located below the first storage unit and a second heater located below the second storage unit.

Each of the first heater and the second heater may be located so as to be spaced apart from the first storage unit and the second storage unit.

The first heater and the second heater may be driven independently of each other.

The first heater and the second heater may include heating wires, and the heating wires may be arranged at a higher density in a front region of the storage compartment than in a rear region of the storage compartment.

The first heater and the second heater may supply a greater amount of heat to the front region of the storage compartment than in the rear region of the storage compartment.

The door may include a front portion located at a front side of the cabinet, and an upper surface portion horizontally extending from one end of the front portion, and the upper surface portion may be provided with a display unit for providing information related to the storage compartment.

The display unit on the upper surface portion may be covered with the cabinet and may not be exposed to a user when the door closes the storage compartment.

The display unit may include a first display unit for providing information related to the first storage unit and a second display unit for providing information related to the second storage unit.

The first display unit may be located on a left side of the upper surface portion, and the second display unit may be located on a right side of the upper surface portion, and the first display unit and the second display unit may provide information independently of each other.

The door may include a front portion located at a front side of the cabinet, and an upper surface portion horizontally extending from one end of the front portion, and the upper surface portion may be provided with an input unit for setting a temperature in the storage compartment.

The input unit may include a first input unit for inputting information related to the first storage unit and a second input unit for providing information related to the second storage unit.

The first input unit may be located on a left side of the upper surface portion and the second input unit may be located on a right side of the upper surface portion, and information input via the first input unit and information input via the second input unit may be performed independently of each other.

Any one of the first storage unit and the first cover may include a magnet, and a remaining one thereof may include a member affected by magnetic attraction of the magnet.

Any one of the second storage unit and the second cover may include a magnet, and a remaining one thereof may include a member affected by magnetic attraction of the magnet.

The storage unit may further include a first rail coupled to each end of each of the first cover and the second cover for guiding movement of the first cover and the second cover.

The storage compartment may include a second rail provided on a sidewall thereof and coupled to the door so as to guide movement of the door in the front-and-rear direction, and the first rail may be seated on the second rail so as to allow the storage unit to be moved when the door is moved.

The first cold air supply duct and the second cold air supply duct may be connected to a duct unit, into which cold air is introduced from an evaporator, and the duct unit may be provided with a first damper and a second damper, which selectively open or close the first cold air supply duct and the second cold air supply duct respectively.

The refrigerator may further include a first heater located below the first storage unit, and, when the first heater is operated, the second cold air supply duct may supply a greater amount of cold air than an amount of cold air supplied when the first heater is not operated.

The refrigerator may further include a second heater located below the second storage unit, and when the second heater is operated, the first cold air supply duct may supply a greater amount of cold air than an amount of cold air supplied when the second heater is not operated.

The refrigerator may further include a first heater located below the first storage unit, and a second heater located below the second storage unit, and when a difference between set temperatures of the first storage unit and the second storage unit is increased, an operation factor of the heater that is operated may be increased compared to a case where the set temperatures of the first storage unit and the second storage unit are the same.

When a difference between set temperatures of the first storage unit and the second storage unit is increased, a greater amount of cold air may be supplied compared to a case where the set temperatures of the first storage unit and the second storage unit are the same.

The refrigerator may further include a refrigerating compartment provided in the cabinet at an upper side of the storage compartment so as to be isolated from the storage compartment, and a freezing compartment provided in the cabinet at a lower side of the storage compartment so as to be isolated from the storage compartment.

Cold air may be supplied to the first cold air supply duct and the second cold air supply duct from an evaporator that supplies cold air to the refrigerating compartment.

The first storage unit may be controlled so as to be maintained at a temperature equal to or above zero degrees, and the second storage unit may be controlled so as to be maintained at a temperature equal to or below zero degrees.

The first storage unit may be controlled so as to be maintained at a temperature similar to a control temperature of the refrigerating compartment, and the second storage unit may be controlled so as to be maintained at a temperature similar to a control temperature of the freezing compartment.

Advantageous Effects of Invention

According to the present invention, a first storage unit and a second storage unit, which are maintained at different temperatures, may be provided in a single storage compartment so as to allow a user to keep storage items at different temperatures in the single storage compartment. That is, both the first storage unit and the second storage unit may be used as a freezing compartment, both the first storage unit and the second storage unit may be used as a refrigerating compartment, or any one of the first storage unit and the second storage unit may be used as a refrigerating compartment and the other one may be used as a freezing compartment.

In addition, according to the present invention, a heater for supplying heat and a cold air supply duct for supplying cold air may be provided in the storage compartment, which may enable precise control of the temperature in the storage compartment.

In addition, according to the present invention, the controllable temperature range of the storage compartment may be widened through the use of the heater and the cold air supply duct, which may enable the storage of various items in the storage compartment.

In addition, according to the present invention, the first storage unit provided in the left side may be controlled to a temperature similar to that in a refrigerating compartment located above the storage compartment, and the second storage unit provided in the right side may be controlled to a temperature similar to that in a freezing compartment located below the storage compartment, which may allow a user to easily recognize the control temperatures of the first storage unit and the second storage unit provided in the storage compartment.

In addition, according to the present invention, a first cover and a second cover may be separated from each other so as to be individually moved. As such, even if the first storage unit and the second storage unit are accommodated in a single storage compartment, the first storage unit and the second storage unit may be maintained at different temperatures.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a schematic view illustrating an embodiment of the present invention;

FIG. 2 is a side sectional view illustrating major parts of the embodiment;

FIG. 3 is a front sectional view illustrating major parts of a storage compartment;

FIG. 4 is a cut-away view of the storage compartment viewed from the top side;

FIG. 5 is a view illustrating a cold air supply duct and a storage unit;

FIG. 6 is a front view illustrating the embodiment of the present invention;

FIG. 7 is a front sectional view of the storage compartment;

FIGS. 8 and 9 are views for explaining an upper structure of the storage compartment;

FIG. 10 is a view for explaining the flow of cold air supplied to a first storage unit;

FIG. 11 is a view for explaining the flow of cold air supplied to a second storage unit;

FIG. 12 is a view illustrating the storage compartment viewed from the top side;

FIG. 13A is a view illustrating an upper surface portion of a door;

FIG. 13B is a view illustrating information regarding selectable settings with reference to the first storage unit;

FIG. 13C is a view illustrating information regarding selectable settings with reference to the second storage unit;

FIG. 14 is a view illustrating a sidewall of the storage compartment; and

FIG. 15 is a view illustrating the rear side of the storage unit.

BEST MODE FOR CARRYING OUT THE INVENTION

Hereinafter, exemplary embodiments of the present invention for concretely realizing the objects described above will be described in detail with reference to the accompanying drawings.

The size, shape or the like of constituent elements illustrated in the drawings may be exaggerated for clarity and convenience of description. In addition, the terms particularly defined in consideration of configurations and operations of the present invention may be replaced by other terms based on intensions of those skilled in the art or customs. The meanings of these terms may be construed based on the overall content of this specification.

FIG. 1 is a schematic view illustrating an embodiment of the present invention.

Referring to FIG. 1, the embodiment of the present invention includes a cabinet 10 defining the external appearance thereof, and an inner case 20 coupled to the cabinet 10. The inner case 20 is provided with a plurality of spaces, which may define a plurality of independent storage spaces.

The respective spaces, defined in the inner case 20, include an upper refrigerating compartment 30, which may store food at a temperature above zero degrees, and a lower freezing compartment 40, which may store food at a temperature below zero degrees. In addition, a storage compartment 50 is provided between the refrigerating compartment 30 and the freezing compartment 40, and serves as a storage space separated from the refrigerating compartment 30 and the freezing compartment 40.

Cold air is supplied to the storage compartment 50 through a duct, which is different from ducts for supplying cold air into the refrigerating compartment 30 and the freezing compartment 40. That is, although the duct for supplying cold air into the storage compartment 50 may be connected to the duct for supplying cold air into the refrigerating compartment 30 or the freezing compartment 40, the duct for supplying cold air into the refrigerating compartment 30 or the freezing compartment 40 is not used to supply cold air into the storage compartment 50. That is, because the duct for supplying cold air into the storage compartment 50 is provided separately, the storage compartment 50 may define a separate storage space, which is isolated from both the refrigerating compartment 30 and the freezing compartment 40.

The entire storage compartment 50 may be sealed or opened by a single door 70 because it defines a single partitioned space. That is, the user may open the storage compartment 50 by moving the single door 70. When the user moves the door 70 forward, the entire space in the storage compartment 50 may be opened. When the user moves the door 70 rearward, the entire space in the storage compartment 50 may be sealed from the outside.

The door 70 includes an upper surface portion 72 at the upper side thereof. The user may access the upper surface portion 72 after pulling the door 70 from the storage compartment 50. When the user moves the door 70 rearward in order to seal the storage compartment 50, the upper surface portion 72 is not exposed to the user, and the user cannot access the upper surface portion 72.

The door 70 may further include a front portion 71 located at the front of the cabinet 10, and the upper surface portion 72 horizontally extends from one end of the front portion 71.

The front portion 71 may be provided with a handle, which assists the user in gripping the door 70.

The door 70 is fixed to the inner sidewall of the storage compartment 50 via a second rail 800 so as to be pulled outward in the front-and-rear direction. The second rail 800 may guide the door 70 so as to be linearly moved toward or away from the storage compartment 50.

The second rail 800 includes a plurality of links. When the links of the second rail 800 overlap each other so that the second rail 800 is folded, the door 70 may be moved toward the storage compartment 50. Conversely, when the links of the second rail 800 spread so that the overlapping area thereof is reduced, the door 70 may be moved away from the storage compartment 50.

A storage unit 100, which may store food therein, may be seated on the second rail 800 so as to be movable along the second rail 800. Specifically, when the second rail 800 is unfolded thus causing the door 70 to be pulled forward, the storage unit 100 is also pulled forward along with the door 70. Conversely, when the second rail 800 is folded thus causing the door 70 to be pushed rearward, the storage unit 100 is also pushed rearward along with the door 70.

The storage unit 100 includes two storage spaces separated from each other. Specifically, a first storage unit 200 may be provided in the left side of the storage unit 100 and may be opened or closed by a first cover 210. A second storage unit 300 may be provided in the right side of the storage unit 100 and may be opened or closed by a second cover 310.

When the storage unit 100 is moved in the front-and-rear direction along with the door 70, the first cover 210 and the second cover 310 remain at their positions relative to the storage unit 100, regardless of the movement of the door 70 or the storage unit 100. Therefore, the first storage unit 200 and the second storage unit 300 may remain sealed by the first cover 210 and the second cover 310.

The user needs to move the first cover 210 in order to retrieve food stored in the first storage unit 200 or to introduce food into the first storage unit 200. Likewise, the user needs to move the second cover 310 in order to retrieve food stored in the second storage unit 300 or to introduce food into the second storage unit 300.

In summary, the present invention provides a refrigerator including the cabinet 10, the storage compartment 50, which is provided in the cabinet 10 so as to define a single space for storing items therein, the single door 70 for opening or closing the space defined by the storage compartment 50, and the storage unit 100, which is pushed into or pulled from the storage compartment 50 in the front-and-rear direction along with the door 70, and the storage unit 100 includes the first storage unit 200 provided in the left side thereof, the second storage unit 300 provided in the right side thereof, the first cover 210 for opening or closing an opening formed in the upper side of the first storage unit 200, and the second cover 310 for opening or closing an opening provided in the upper side of the second storage unit 300, the second cover 310 being movable separately from the first cover 210.

At this time, the storage space in the first storage unit 200 may be sealed from the space in the storage compartment 50 by the first cover 210 provided at the upper side of the first storage unit 200, and the storage space in the second storage unit 300 may be sealed from the space in the storage compartment 50 by the second cover 310 provided at the upper side of the second storage unit 300. Accordingly, the first storage unit 200 and the second storage unit 300 may define sealed spaces separated from each other, and consequently, the first storage unit 200 and the second unit 300 may be maintained at different temperatures.

FIG. 2 is a side sectional view illustrating major parts of the embodiment, FIG. 3 is a front sectional view illustrating major parts of the storage compartment, and FIG. 4 is a cut-away view of the storage compartment viewed from the top side. In FIG. 3, for convenience of description, the state in which the covers provided at the storage units are removed is illustrated.

Referring to FIGS. 2 to 4, the storage unit 100 includes an insulator 400, which is located between the first storage unit 200 and the second storage unit 300 and separates the first storage unit 200 and the second storage unit 300 from each other. The insulator 400 is formed of a heat insulation material and realizes thermal isolation between the first storage unit 200 and the second storage unit 300. The insulator 400 may have a greater thickness than the thickness of the wall of the first storage unit 200 or the second storage unit 300, and thus may have greater insulation performance than the wall of the first storage unit 200 or the wall of the second storage unit 300. Accordingly, the temperature inside the first storage unit 200 may have no effect on the temperature inside the second storage unit 300, and the first storage unit 200 and the second storage unit 300 may be maintained at different respective temperatures.

Each of the first storage unit 200 and the second storage unit 300 may have a small thickness in order to increase the food storage capacity therein. Therefore, in the state in which food is stored in the first storage unit 200 and the second storage unit 300, the storage unit 100 may be deformed by the load applied to the first storage unit 200 and the second storage unit 300. In order to prevent such deformation, the insulator 400 may be thicker than thickness of the wall of the first storage unit 200 or the second storage unit 300 in order to secure the strength of the storage unit 100.

The insulator 400 is provided with ribs 410, which extend downward. The ribs 410 may prevent the movement of air between the space containing the first storage unit 200 and the space containing the second storage unit 300, thereby allowing the first storage unit 200 and the second storage unit 300 to be maintained at different temperatures.

Although the ribs 410 may be altered in various shapes, the rib 410 may include a pair of ribs, which extends downward from opposite sides of the insulator 400. The ribs 410 may be formed of a material, which is different from that of the insulator 400 and is stronger than that of the insulator 400. Because the ribs 410 also function to surround the insulator 400 so as to prevent the insulator 400 from being exposed to the outside, the insulator 400 may be protected by the ribs 410. Owing to the provision of the ribs 410, the insulator 400 may be formed of a material that has high heat insulation performance, but low strength.

The storage compartment 50 includes a bottom surface 74 defining the external appearance of the lower space in the storage compartment 50. The bottom surface 74 may mean the bottom of the storage compartment 50 in the inner case 20. An insulating partition 500 is provided on the bottom surface 74. The insulating partition 500 may also be formed of a heat insulation material, and thus may prevent the flow of air in order to prevent the air from easily moving between the space containing the first storage unit 200 and the space containing the second storage unit 300. Accordingly, cold air may not easily move between the first storage unit 200 and the second storage unit 300, and the temperatures in the first storage unit 200 and the second storage unit 300 may be maintained individually or independently of each other.

The insulating partition 500 is provided with a housing 510, which defines the external appearance of the insulating partition 500 and accommodates the insulating partition 500 therein. The housing 510 may be formed of a material having higher strength than the insulating partition 500 and may prevent the insulating partition 500 from being exposed outward, thereby preventing damage to the insulating partition 500 due to external force.

The insulating partition 500 may have a greater vertical height than the insulator 400. Because the insulating partition 500 is fixed rather than being moved along with the storage unit 100, the user may move the storage unit 100 with low force when a relatively small insulator is provided in the storage unit 100.

Meanwhile, the insulating partition 500 may include a plurality of stepped portions. The insulator 400 may also include stepped portions corresponding to those of the insulating partition 500. As such, when the insulator 400 is located on the insulating partition 500, the insulator 400 and the insulating partition 500 may limit the flow of air in the left-and-right direction.

The housing 510 includes ribs 520 protruding from the outer circumferential surface thereof. The ribs 520 may be spaced apart from the ribs 410 and may be shaped so as to engage with the ribs 410. As such, the ribs 520 and the ribs 410 may prevent air in the space containing the first storage unit 200 and air in the space containing the second storage unit 300 from easily mixing with each other. That is, the ribs 410 and the ribs 520 may complicate a path, along which the air in the space containing the first storage unit 200 and the air in the space containing the second storage unit 300 may move in order to mix with each other, thereby allowing the first storage unit 200 and the second storage unit 300 to be maintained at different temperatures.

When the storage unit 100 is pushed into the storage compartment 50, the insulating partition 500 is located just below the insulator 400. As such, the ribs 410 and the ribs 520 are arranged to face each other, thereby providing a complicated air movement path.

The insulating partition 500 is provided with a plurality of rollers 530, which supports the bottom of the insulator 400 so that the insulator 400 is movable. The rollers 530 may allow the insulating partition 500 to support various points of the insulator 400.

In order to allow the storage unit 100 to be moved into the storage compartment 50, the insulating partition 500 and the insulator 400 require a gap therebetween. In order to prevent air from easily moving through the gap, in the present invention, the ribs 410 and the ribs 520 are provided.

In addition, the rollers 530 may protrude from the insulating partition 500 so as to come into contact with the ribs 410 because they need to support the insulator 400. For this reason, the gap between the insulator 400 and the insulating partition 500 may be set to allow the ribs 410 to extend downward toward the insulating partition 500 on opposite sides of the rollers 530 so as to define gaps between the ribs 410 and the rollers 530 for preventing air from easily moving in the left-and-right direction.

The first storage unit 200 and the second storage unit 300 may configure a single large basket having two storage spaces separated from each other. Thus, the first storage unit 200 and the second storage unit 300 may be connected to each other.

The insulator 400 may be provided at the upper side thereof with a portion for connecting the first storage unit 200 and the second storage unit 300 to each other, and a rib 430 on which the first cover 210 and the second cover 310 may be seated may be provided at the upper side of the connection portion. The rib 430 may form a structure that allows the first cover 210 and the second cover 310 to move in the front-and-rear direction.

A gasket 60 is provided on the ceiling of the storage compartment 50. The gasket 600 may extend downward from the ceiling of the storage compartment 50, and may serve to reduce the amount of air moving between the space containing the first storage unit 200 and the space containing the second storage unit 300.

The gasket 600 may be located above the insulator 400 in the state in which the storage unit 100 is pushed into the storage compartment 50. In order to install the gasket 600 to the ceiling of the storage compartment 50, a gasket housing 610 may be installed to the ceiling of the storage compartment 50 while fixing the gasket 600. At this time, the gasket housing 610 may be oriented so as to face the ceiling surface of the storage compartment 50, and a fixing member 630 for fixing the gasket housing 610 may be provided on the outer wall of the ceiling surface of the storage compartment 50. That is, the gasket housing 610 is located below the ceiling surface of the storage compartment 50 and the fixing member 630 is located above the ceiling surface of the storage compartment 50 so that the gasket 600 may be installed so as to be exposed downward from the storage compartment 50.

The ceiling of the storage compartment 50 may be formed of a plastic or an acrylonitrile butadiene styrene (ABS) resin, which does not cause large flow resistance, in order to allow cold air to easily move in the front-and-rear direction. That is, the ceiling of the storage compartment 50 may be formed of a material such as one that is conventionally applied to the inner case of the refrigerator. When the gasket 600 protrudes from the ceiling of the storage compartment 50, which is formed of the material described above, air or cold air may not easily move in the left-and-right direction of the storage compartment 50.

The insulating partition 500 is provided below the storage unit 100 and the gasket 600 is provided above the storage unit 100, which may prevent air inside the storage compartment 50 from easily moving in the left-and-right direction. The insulating partition 500 may be formed of a stronger material than that of the gasket 600 because it also needs to support the storage unit 100. Conversely, because the gasket 600 does not support the storage unit 100 and simply limits the air movement path in the left-and-right direction, the gasket 600 may be formed of a relatively easily deformable material, which may reduce the cost of manufacturing the refrigerator.

Referring to FIG. 4, a protrusion 580 is provided on a front portion of the storage compartment 50 (i.e. a portion facing the door 70) so as to protrude toward the storage unit 100. The protrusion 580 is provided with a rib 590 so as to prevent air from mixing in the left-and-right direction within the storage compartment 50.

The insulator 400 may be provided with a first protruding piece 700 on a portion thereof facing the rib 590. The first protruding piece 700 may be formed in a shape that engages with the rib 590. Thereby, the rib 590 and the first protruding piece 700 may prevent air in the space containing the first storage unit 200 and air in the space containing the second storage unit 300 from mixing at the front of the storage compartment 50. That is, the first protruding piece 700 may extend toward the door 70, thereby preventing air from moving between the left side and the right side in the storage compartment 50.

The rib 590 may be configured as a single protruding member, and the first protruding piece 700 may be configured as two members so as to surround opposite sides of the rib 590 so that two protruding pieces 700 are spaced apart from the rib 590 and surround the rib 590.

An insulation member 560 is provided on a rear portion of the storage compartment 50 (i.e. a portion facing the direction at the opposite side of the door 70) so as to face the storage unit 100. The insulation member 560 may be formed of a heat insulation material. A rib 570 is formed on the insulation member 560 so as to protrude toward the door 70. The rib 570 may be configured as a plurality of protruding members. As such, the rib 570 may prevent the movement of air in the left-and-right direction in the storage compartment 50.

The insulator 400 may be provided with a second protruding piece 750 on the surface thereof facing the inside of the storage compartment 50. The second protruding piece 750 may extend in the inward direction of the storage compartment 50, thereby preventing air from moving between the left side and the right side in the storage compartment 50.

The second protruding piece 750 may be configured as a plurality of members provided on opposite sides of the rib 570 so as to surround the rib 570. As such, the second protruding piece 750 and the rib 570 may prevent the easy mixing of air between the left space and the right space in the storage compartment 50. Accordingly, foods stored in the first storage unit 200 and the second storage unit 300 may be maintained at different temperatures.

FIG. 5 is a view illustrating a cold air supply duct and the storage unit. In FIG. 5, for convenience of description, the outer contour line of the storage compartment is omitted, and only the storage unit and the cold air supply duct are illustrated.

Referring to FIG. 5, in the present embodiment, a first cold air supply duct 1100 and a second cold air supply duct 1200 are respectively provided on left and right sides of the single storage compartment 50 so as to supply different amounts of cold air. When two cold air supply ducts are provided to the single storage compartment 50, the single storage compartment 50 may exhibit different cold air supply characteristics depending on positions thereof.

The storage compartment 50 defines a single space therein, into which cold air supplied from the first cold air supply duct 1100 and the second cold air supply duct 1200 may move. Although two cold air supply ducts are arranged on the single storage compartment 50 so as to supply cold air into the single space, the two cold air supply ducts may supply different amounts of cold air, thus causing the distribution of different temperatures in the single storage compartment 50, which may allow foods that need to be stored at different temperatures to be organized and stored in the first storage unit 200 and the second storage unit 300.

The first cold air supply duct 1100 mainly supplies cold air to the first storage unit 200, and the second cold air supply duct 1200 mainly supplies cold air to the second storage unit 300. The first cold air supply duct 1100 may discharge cold air toward the first storage unit 200, and the second cold air supply duct 1200 may discharge cold air toward the second storage unit 300.

The first cold air supply duct 1100 includes an outlet port 1110 through which cold air is discharged toward the first storage unit 200, and the second cold air supply duct 1200 includes an outlet port 1210 through which cold air is discharged toward the second storage unit 300.

The first cold air supply duct 1100 and the second cold air supply duct 1200 may be connected to a single duct unit 1000 to which cold air is supplied. As such, the cold air supplied through the duct unit 1000 may be distributed to the first cold air supply duct 1100 and the second cold air supply duct 1200, thereby being supplied to the storage compartment 50.

A first damper 1120 and a second damper 1130 are provided on portions at which the duct unit 1000 meets the first cold air supply duct 1100 and the second cold air supply duct 1200. When the first damper 1120 opens a flow path through which cold air is supplied, cold air moves from the duct unit 1000 to the first cold air supply duct 1100, thereby being supplied to the storage compartment 50 through the first cold air supply duct 1100. When the second damper 1130 opens a flow path through which cold air is supplied, cold air moves from the duct unit 1000 to the second cold air supply duct 1200, thereby being supplied to the storage compartment 50 through the second cold air supply duct 1200.

Although both the first cold air supply duct 1100 and the second cold air supply duct 1200 are connected to the duct unit 1000, the amounts of cold air supplied through the first cold air supply duct 1100 and the second cold air supply duct 1200 may differ because the opening or closing of the flow paths is individually performed by the first damper 1120 and the second damper 1130. Accordingly, different amounts of cold air may be supplied to the first storage unit 200 and the second storage unit 300, whereby the first storage unit 200 and the second storage unit 300 may have different temperature distributions.

The cold air supply duct 1100 and the second cold air supply duct 1200 may be arranged in the upper region of the storage compartment 50 so as to discharge cold air downward. Because cold air typically tends to move downward because of the relatively high density thereof, cold air may be efficiently supplied to the first storage unit 200 or the second storage unit 300.

The outlet port 1110 in the first cold air supply duct 1100 and the outlet port 1210 in the second cold air supply duct 1200 may be located at the center of the front-and-rear length of the storage compartment 50. When the outlet port 1110 in the first cold air supply duct 1100 and the outlet port 1210 in the second cold air supply duct 1200 are located at the center of the front-and-rear length of the storage compartment 50, the first storage unit 200 and the second storage unit 300 may be efficiently cooled.

The duct unit 1000 may receive cold air supplied from an evaporator that supplies cold air into the refrigerating compartment, or may receive cold air from an evaporator that supplies cold air into the freezing compartment. When the duct unit 1000 receives cold air supplied from the evaporator that supplies cold air into the refrigerating compartment, cold air at a higher temperature than that from the evaporator for the freezing compartment may be supplied to the duct unit 1000, which may advantageously enable more precise control of the temperature inside the storage compartment 50.

Although cold air discharged from the first cold air supply duct 1100 and cold air discharged from the second cold air supply duct 1200 may mix with each other, the streams of cold air may not easily mix with each other and the temperatures thereof may be maintained independently of each other because a passage, along which air needs to move in order to mix, is complicated and is increased in length due to the ribs, the protrusion, the protruding pieces, etc. described above.

FIG. 6 is a front view illustrating the embodiment of the present invention.

Referring to FIG. 6, when viewing the inner case 20 from the front side thereof, cold air supplied from the first cold air supply duct 1100 and the second cold air supply duct 1200 is discharged from the storage compartment 50 through a discharge opening 80 formed in the rear surface of the storage compartment 50.

That is, the discharge opening 80 is formed in the rear surface of the storage compartment 50 so that air inside the storage compartment 50 is discharged outward through the discharge opening 80. The discharge opening 80 is located at the center in the left-and-right length of the rear surface. In the storage compartment 50, the first cold air supply duct 1100 is located so as to deviate leftward, and the second cold air supply duct 1200 is located so as to deviate rightward. Because the discharge opening 80 serves as a passage, through which cold air supplied from both the first cold air supply duct 1100 and the second cold air supply duct 1200 is discharged, the discharge opening 80 may be located at the center of the rear surface of the storage compartment 50.

In addition, the refrigerator includes a temperature sensor for measuring the temperature inside the storage compartment 50. The temperature sensor is spaced apart from the discharge opening 80. In the region close to the discharge opening 80, air may flow at a high rate, and thus variation in temperature may easily occur. For example, because the temperature drops more easily in the region close to the discharge opening 80 than in other regions when cold air begins to be supplied, measuring the actual temperature in the storage compartment 50 may be difficult at the position close to the discharge opening 80.

The temperature sensor includes a first temperature sensor 1300 for measuring the temperature in the left space of the storage compartment 50, and a second temperature sensor 1400 for measuring the temperature in the right space of the storage compartment 50.

The first temperature sensor 1300 may be located at a position spaced apart from the discharge opening 80, i.e. at the left corner of the storage compartment 50. The second temperature sensor 1400 may be located at a position spaced apart from the discharge opening 80, i.e. at the right corner of the storage compartment 50.

The first temperature sensor 1300 may measure the temperature in the space containing the first storage unit 200, and the second temperature sensor 1400 may measure the temperature in the space containing the second storage unit 300. Because the first temperature sensor 1300 and the second temperature sensor 1400 are spaced apart from each other, interference between the temperatures measured by the two temperature sensors may not occur.

The first temperature sensor 1300 and the second temperature sensor 1400 are located at positions symmetrical to each other about the discharge opening 80, thereby stably measuring the temperatures corresponding to the respective positions.

FIG. 7 is a front sectional view of the storage compartment.

In FIG. 7, the storage unit 100 is in the state of being inserted into the storage compartment 50.

Referring to FIG. 7, the outlet port 1110 and the outlet port 1210 in the first cold air supply duct 1100 and the second cold air supply duct 1200 are located to penetrate the ceiling of the storage compartment 50. Cold air supplied from the outlet ports 1110 and 1210 moves downward from the upper side of the storage compartment 50.

The second rails 800 are provided on the respective sidewalls of the storage compartment 50 so that the storage unit 100 is seated on the second rails 800.

The storage unit 100 includes first rails 810, which are respectively coupled to opposite ends of each of the first cover 210 and the second cover 310 so as to guide the movement of the first cover 210 and the second cover 310. The first rails 810, which are respectively provided on opposite ends of each of the first cover 210 and the second cover 310, may guide the movement of the first cover 210 and the second cover 310 in the front-and-rear direction.

The first rails 810 may be seated on the second rails 800 so as to allow the storage unit 100 to be moved in response to the movement of the second rails 800.

Guide ribs 90 are provided on the bottom surface 74 of the storage compartment 50 and extend a long length in the front-and-rear direction of the storage compartment 50. The guide ribs 90 may have various shapes and may be sequentially distributed in the left-and-right direction.

The guide ribs 90 extend so as to have the same shape in the front-and-rear direction of the storage compartment 50, thereby causing the air inside the storage compartment to move in the front-and-rear direction, rather than moving in the left-and-right direction. Due to the convex and concave shape of the guide ribs 90, the air is guided to move in the front-and-rear direction, rather than moving in the left-and-right direction, between the first storage unit 200 and the second storage unit 300, which are located in the storage compartment 50.

The guide ribs 90 may protrude from the bottom surface 74 so as to have a relatively high height, or may protrude from the bottom surface 74 so as to have a relatively low height. The plural guide ribs 90 arranged on the bottom surface 74 may cause air to move in a constant direction inside the storage compartment 50.

FIGS. 8 and 9 are views for explaining an upper structure of the storage compartment.

Referring to FIGS. 8 and 9, the inner case 20 is provided with a slope 22 on the portion thereof defining the ceiling of the storage compartment 50. Thus, it may be difficult to install the gasket 600 having a rectangular shape on the ceiling of the storage compartment 50. Therefore, after first fixing the gasket 600 to the gasket housing 610, the gasket housing 610 may be fixed to the ceiling of the storage compartment 50, which ensures easy installation work.

A through-hole 640 is formed in the ceiling of the storage compartment 50 so that the fixing member 630 penetrates the through-hole 640 from the upper side of the ceiling of the storage compartment 50 so as to be coupled to the gasket housing 610.

The fixing member 630 and the gasket housing 610 are vertically coupled to each other through the through-hole 640 formed in the ceiling of the storage compartment 50, i.e. in the inner case 20. As such, the gasket 600 may be stably fixed to the upper side of the storage compartment 50, thereby preventing air from easily moving in the left-and-right direction within the storage compartment 50.

The gasket housing 610 extends a long length in the front-and-rear direction of the storage compartment 50. The gasket housing 610 may be located at the upper side of the gasket 600 so as to come into surface contact with the slope 22.

FIG. 10 is a view for explaining the flow of cold air supplied to the first storage unit.

Referring to FIG. 10, when cold air is supplied from the first cold air supply duct 1100, the cold air may be transferred to the first storage unit 200 through the outlet port 1110. Because the first storage unit 200 has a sealed space therein defined by the first cover 210, the cold air supplied from the first cold air supply duct 1100 is not directly transferred into the first storage unit 200. Accordingly, the food stored in the first storage unit 200 may be maintained at a desired temperature via indirect cooling.

The cold air discharged from the outlet port 1110 passes the upper side of the first cover 210 and moves to the front side at which the door 70 is located.

A first space 57 is provided between the door 70 and the first storage unit 200 so as to form a path for the movement of cold air. The cold air may pass through the first space 57 so as to surround the front side of the first storage unit 200, and thereafter may pass the bottom surface of the storage compartment 50, thereby being discharged outward through the discharge opening 80.

Because the cold air discharged through the outlet port 1110 moves toward the front side of the first storage unit 200, the flow of cold air discharged from the first cold air supply duct 1100 shows a strong tendency to move in the front-and-rear direction.

In addition, as described above, due to the arrangement of, for example, the guide ribs, the plural ribs for preventing the flow of air in the left-and-right direction, the insulation wall, and the insulator, the cold air discharged from the first cold air supply duct 1100 may move forward while surrounding the first storage unit 200 and then move rearward while surrounding the first storage unit 200, as illustrated in FIG. 10, rather than moving into the region in which the second storage unit 300 is located.

Accordingly, the cold air discharged from the first cold air supply duct 1100 sufficiently undergoes heat exchange with the first storage unit 200 while surrounding the first storage unit 200, thereby maintaining the temperature in the first storage unit 200 at a set temperature.

FIG. 11 is a view for explaining the flow of cold air supplied to the second storage unit.

Referring to FIG. 11, when cold air is supplied from the second cold air supply duct 1200, the cold air may be transferred to the second storage unit 300 through the outlet port 1210. Because the second storage unit 300 has a sealed space therein defined by the second cover 310, the cold air supplied from the second cold air supply duct 1200 is not directly transferred into the second storage unit 300. Accordingly, the food stored in the second storage unit 300 may be maintained at a desired temperature via indirect cooling.

The cold air discharged from the outlet port 1210 passes the upper side of the second cover 310 and moves to the front side, at which the door 70 is located.

A second space 58 is provided between the door 70 and the second storage unit 300 so as to form a path for the movement of cold air. The cold air may pass through the second space 58 so as to surround the front side of the second storage unit 300, and thereafter may pass the bottom surface of the storage compartment 50, thereby being discharged outward through the discharge opening 80.

Because the cold air discharged through the outlet port 1210 moves toward the front side of the second storage unit 300, the flow of air discharged from the second cold air supply duct 1200 shows a strong tendency to move in the front-and-rear direction.

In addition, as described above, due to the arrangement of, for example, the guide ribs, the plural ribs for preventing the flow of air in the left-and-right direction, the insulation wall, and the insulator, the cold air discharged from the second cold air supply duct 1200 may move forward while surrounding the second storage unit 300 and then move rearward while surrounding the second storage unit 300, as illustrated in FIG. 11, rather than moving to the region in which the first storage unit 200 is located.

Accordingly, the cold air discharged from the second cold air supply duct 1200 sufficiently undergoes heat exchange with the second storage unit 300 while surrounding the second storage unit 300, thereby maintaining the temperature in the second storage unit 300 at a set temperature.

Referring to FIGS. 10 and 11, the first storage unit 200 and the second storage unit 300 may be spaced apart from the bottom surface 74 of the storage compartment 50 so as to form a path, through which the cold air, sprayed from the respective cold air supply ducts, passes between the first storage unit 200, the second storage unit 300, and the bottom surface 74.

That is, in the present embodiment, the cold air discharged from the first cold air supply duct 1100 and the second cold air supply duct 1200 may cool the first storage unit 200 and the second storage unit 300 while moving through the determined path, but may not be mixed. As such, the first storage unit 200 and the second storage unit 300 may be cooled to different temperatures, and may be maintained at the respective cooling temperatures.

FIG. 12 is a view illustrating the storage compartment viewed from the top side.

In FIG. 12, the door 70 is located at the lower side.

Referring to FIG. 12, a heater is deeply embedded in the bottom surface 74 so as not to be directly exposed to the storage compartment 50. The heater may include a first heater 1310 located in the left side of the storage compartment 50 and a second heater 1410 located in the right side of the storage compartment 50.

The first heater 1310 is located below the first storage unit 200, and the second heater 1410 is located below the second storage unit 300. At this time, the first heater 1310 and the second heater 1410 are deeply embedded in the bottom surface 74, and therefore are spaced apart from the first storage unit 200 and the second storage unit 300.

The first storage unit 200 may accommodate two kimchi containers 1600. At this time, the two kimchi containers 1600 are respectively located in the front region and the rear region of the first storage unit 200. This may be equally applied to the second storage unit 300.

In the case of keeping kimchi, various settings, such as, for example, a setting for ripening kimchi and a setting for keeping ripened kimchi, may be generally adopted. Because it is necessary to apply heat in order to ripen kimchi, the first heater 1310 and the second heater 1410 may supply heat to the storage compartment 50 so as to control the increase in the temperatures of the first storage unit 200 and the second storage unit 300.

At this time, the first heater 1310 and the second heater 1410 may be driven independently of each other. The first heater 1310 may be driven, whereas the second heater 1410 may not be driven. Conversely, the second heater 1410 may be driven, whereas the first heater 1310 may not be driven. In addition, both the first heater 1310 and the second heater 1410 may be driven, or both the first heater 1310 and the second heater 1410 may not be driven.

The first heater 1310 and the second heater 1410 may include heating wires, and the heating wires may be arranged at a higher density in the front region of the storage compartment 50 than in the rear region of the storage compartment 50. That is, the first heater 1310 and the second heater 1410 may supply a greater amount of heat to the front region of the storage compartment 50 than the rear region of the storage compartment 50.

When the kimchi containers 1600, in which kimchi is stored, are accommodated in the first storage unit 200 and the second storage unit 300, the temperature difference in the front-and-rear direction in the first storage unit 200 and the second storage unit 300 may show that the temperature is lower at the front side (i.e. the side close to the door 70). Thus, the temperature at the front side may be raised when the first heater 1310 and the second heater 1410 supply a greater amount of heat to the front side.

Because the first heater 1310 and the second heater 1410 are symmetrical with each other, the same amount of heat may be supplied to the first storage unit 200 and the second storage unit 300.

FIG. 13A is a view illustrating the upper surface portion of the door.

Referring to FIG. 13A, once the user has pulled the door 70 forward, the user can view the upper surface portion 72 of the door 70.

The upper surface portion 72 is provided with an input unit, which allows the user to set the temperature in the storage compartment 50. The input unit may control the temperature in the storage compartment 50, rather than the refrigerating compartment and the freezing compartment, as described above. After pulling the door 70 forward in order to adjust the temperature in the storage compartment 50, the user may access the upper surface portion 72, thereby adjusting the temperature in the storage compartment 50. The input unit may function to allow the user to select a setting that may be applied to the storage compartment 50. The user may select a setting so as to select an appropriate temperature at which the stored food is kept.

The input unit may include a first input unit 1500 for inputting information related to the first storage unit 200 and a second input unit 1520 for inputting information related to the second storage unit 300. Because the first storage unit 200 and the second storage unit 300 may be set so as to be maintained at different temperatures, two different input units are provided for the single storage compartment.

The first input unit 1500 may be located on the left side of the upper surface portion 72 and the second input unit 1520 may be located on the right side of the upper surface portion 72. The first input unit 1500 and the second input unit 1520 may be used to input information independently of each other. The first input unit 1500 is located close to the first storage unit 200 and the second input unit 1520 is located close to the second storage unit 300. As such, the user may intuitively recognize the portion of the storage compartment 50 to which a setting, input via a corresponding input unit, relates.

The user may select different settings depending on the number of times that the user pushes the first input unit 1500 and the second input unit 1520.

The upper surface portion 72 is provided with a display unit for providing information related to the storage compartment 50. The user may acquire information regarding which setting is applied to the storage compartment 50 via the display unit.

The display unit includes a first display unit 1510 for providing information related to the first storage unit 200 and a second display unit 1530 for providing information related to the second storage unit 300.

The first display unit 1510 may be located on the left side of the upper surface portion 72 and the second display unit 1530 may be located on the right side of the upper surface portion 72. The first display unit 1510 and the second display unit 1530 may be used to provide information independently of each other. Because the first storage unit 200 and the second storage unit 300 may be maintained at different temperatures, information regarding the temperatures in the first storage unit 200 and the second storage unit 300 may be provided to the user independently of each other.

FIG. 13B is a view illustrating information regarding settings provided in the first storage unit 200, and FIG. 13C is a view illustrating information regarding settings provided in the second storage unit 300.

With regard to the first storage unit 200, a kimchi-taste-preserving setting, a vegetable/fruit setting, a ripening setting, and a lactic-acid-kimchi setting may be selected. With regard to the second storage unit 300, a meat/fish setting, a kimchi-taste-preserving setting, a vegetable/fruit setting, and a wine setting may be selected.

The temperature in the first storage unit 200 may be controlled within a range from −1° C. to 6.5° C., and the temperature in the second storage unit 300 may be controlled within a range from −2.5° C. to 5° C. That is, when the user selects an "Upper" item in the kimchi-taste-preserving setting via the first input unit 1500 with regard to the first storage unit 200, the first storage unit 200 may be maintained at the temperature of −1° C. When the user selects the meat/fish setting via the second input unit 1520 with regard to the second storage unit 300, the second storage unit 300 may be maintained at the temperature of −2.5° C.

The first storage unit 200 and the second storage unit 300 may have different temperature ranges, and the control temperature range may be higher for the first storage unit 200 than the second storage unit 300. For example, the user may control the first storage unit 200 to a temperature equal to or above zero degrees, and may control the second storage unit 300 to a temperature equal to or below zero degrees.

The user may control the refrigerating compartment 30, which is located above the storage compartment 50, and the first storage unit 200 so as to have a similar temperature range, and may control the freezing compartment 40, which is located below the storage compartment 50, and the second storage unit 300 so as to have a similar temperature range.

The refrigerating compartment 30 may be maintained at a temperature equal to or above zero degrees, the freezing compartment 40 may be maintained at a temperature equal to or below zero degrees, and the first storage unit 200 and the second storage unit 300 may be changed in various ways by the user as needed. However, because the storage compartment 50 is located between the refrigerating compartment 30 and the freezing compartment 40, the user may manage any one of the two storage units so as to be used as a refrigerating compartment and the other one so as to be used as a freezing compartment when using the storage compartment 50. This advantageously allows the user to easily and intuitively recognize that one storage unit serves as the refrigerating compartment and the other storage unit serves as the freezing compartment.

Meanwhile, when the first storage unit 200 and the second storage unit 300 are set to different temperatures, the first cold air supply duct 1100 and the second cold air supply duct 1200 may supply different amounts of cold air.

At this time, when the first heater 1310, which is located below the first storage unit 200, is driven, the second cold air supply duct 1200 may supply a greater amount of cold air than the amount of cold air supplied when the first heater 1310 is not driven. Although the flow of air within the storage compartment 50 between the space in which the first storage unit 200 is located and the space in which the second storage unit 300 is located is suppressed by elements, such as, for example, the ribs, the protruding pieces, and the insulation wall, the air in the left space and the air in the right space may be mixed and cause heat exchange via radiation or convection, which may occur. Thus, because the first heater 1310 is driven so that the temperature in the space containing the second storage unit 300 may be unintentionally raised, a greater amount of air is supplied through the second cold air supply duct 1200 in order to lower the raised temperature.

Conversely, when the second heater 1410, which is located below the second storage unit 300, is driven, the first cold air supply duct 1100 may supply a greater amount of cold air than the amount of cold air supplied when the second heater 1410 is not driven. Although the flow of air within the storage compartment 50 between the space in which the first storage unit 200 is located and the space in which the second storage unit 300 is located is suppressed by elements, such as, for example, the ribs, the protruding pieces, and the insulation wall, the air in the left space and the air in the right space may be mixed and cause heat exchange via radiation or convection, which may occur. Thus, because the second heater 1410 is driven so that the temperature in the space in which the first storage unit 200 is located may be unintentionally raised, a greater amount of air is supplied through the first cold air supply duct 1100 in order to lower the raised temperature.

The first storage unit 200 and the second storage unit 300 need to be controlled in consideration of each other because the space containing the first storage unit 200 and the space containing the second storage unit 300 within the storage compartment 50 are not completely isolated from each other.

For example, when the ripening setting for the first storage unit 200 is selected so as to maintain the first storage unit 200 at a temperature of 4.5° C. and a "Lower" item of the vegetable/fruit setting for the second storage unit 200 is selected so as to maintain the second storage unit 300 at a temperature of 4.5° C., the first storage unit 200 and the second storage unit 300 may require less consideration of the supply of cold air or the control of the heater because the first storage unit 200 and the second storage unit 300 are maintained at the same temperature.

However, when the lactic-acid-kimchi setting is selected for the first storage unit 200 so as to maintain the first storage unit 200 at a temperature of 6.5° C. and the meat/fish setting is selected for the second storage unit 200 so as to maintain the second storage unit 300 at a temperature of −2.5° C., heat exchange may occur between the first storage unit 200 and the second storage unit 300 via radiation or convection.

Accordingly, a greater amount of heat may be supplied from the first heater 1310 to the first storage unit 200 in order to maintain the first storage unit 200 at the temperature of 6.5° C. compared to the case where the first storage unit forms a single independent space, and a greater amount of cold air may be supplied through the second cold air supply duct 1200 in order to maintain the second storage unit 300 at the temperature of −2.5° C. compared to the case where the second storage unit forms a single independent space.

Of course, when different settings from those described above are selected with regard to the first storage unit 200 and the second storage unit 300, the first cold air supply duct 1100, the second cold air supply duct 1200, the first heater 1310 and the second heater 1410 need to be controlled in the context of other considerations.

When the difference between the set temperatures of the first storage unit 200 and the second storage unit 300 is increased, the operation factor of the heater that is driven may be increased compared to the case where the first storage unit 200 and the second storage unit 300 are set to the same temperature. That is, any one of the first heater 1310 and the second heater 1410, or both heaters, may be driven for a longer time so as to supply a greater amount of heat compared to the case where the first storage unit 200 and the second storage unit 300 are set to the same temperature.

The operation factors of the first heater 1310 and the second heater 1410 may increase by 10% whenever the difference between the temperatures of the first storage unit 200 and the second storage unit 300 increases by 2° C. Thus, the operation factors may increase by 20% when the difference in temperature increases by 4° C. and may increase by 30% when the difference in temperature increases by 6° C.

In addition, when the difference between the set temperatures of the first storage unit 200 and the second storage unit 300 is increased, the amount of cold air to be supplied may be increased compared to the case where first storage unit 200 and the second storage unit 300 are set to the same temperature. That is, any one of the cold air supply duct 1100 and the second cold air supply duct 1200 or both cold air supply ducts may be driven for a longer time so as to supply a greater amount of cold air compared to the case where the first storage unit 200 and the second storage unit 300 are set to the same temperature.

In the present embodiment, because one storage compartment is divided into two storage spaces, which require different storage temperatures so that the two storage spaces are maintained at different temperatures, the heater and the cold air supply duct provided in one storage space are affected by the heater and the cold air supply duct provided in the other storage space. Accordingly, when the two storage spaces within the single storage compartment are set to different temperatures, in order to maintain the set different temperatures, a different control mode from that in the case where a heater and a cold air supply duct are used to control a single sealed space is required.

The temperature in the first storage unit 200 may be managed by the first cold air supply duct 1100 and the first heater 1310, and the temperature in the second storage unit 300 may be managed by the second cold air supply duct 1200 and the second heater 1410. However, because the first storage unit 200 and the second storage unit 300 define spaces that are not completely sealed from each other, the management of the temperature in the first storage unit 200 may be affected by the second cold air supply duct 1200 and the second heater 1410. In the same manner, the management of the temperature in the second storage unit 300 may be affected by the first cold air supply duct 1100 and the first heater 1310.

FIG. 14 is a view illustrating the sidewall of the storage compartment.

In order to supply electricity to the first display unit 1510 and the second display unit 1530 installed to the door 70, an electric wire 1600 may be installed in the second rail 800. That is, the electric wire 1600 connected to the cabinet 10 may extend to the door 70 by passing through the second rail 800.

Because the second rail 800 includes the plurality of links so as to perform only the overlapping or spreading of the links, a short circuit due to deformation of the electric wire 1600 located in the second rail 800, such as crumpling of the electric wire 1600, may be prevented.

The electric wire 1600 may also supply electricity to the first input unit 1500 and the second input unit 1520.

Signals generated in the first input unit 1500, the second input unit 1520, the first display unit 1510 and the second display unit 1530 may be transmitted to a main controller of the refrigerator through the electric wire 1600.

FIG. 15 is a view illustrating the rear side of the storage unit.

Referring to FIG. 15, a magnet may be provided on any one of the second storage unit 300 and the second cover 310, and a member, which is affected by the magnetic attraction of the magnet, may be provided on the other one. Because cold air is not directly introduced into the second storage unit 300 when the second cover 310 seals the second storage unit 300, the temperature in the second storage unit 300 may be stably maintained, rather than being momentarily changed by the cold air. Accordingly, the second storage unit 300 may remain sealed by the second cover 310 when it is desired to precisely control the temperature in the second storage unit 300.

To this end, a magnet 320 may be installed on the second cover 310, and a member 330, which may be attached to the magnet 320, may be provided on the second storage unit 300. The member 330 of the second storage unit 300, which may be attached to the magnet 320, may also be a magnet.

In the same manner, a magnet may be provided on any one of the first storage unit 200 and the first cover 210, and a member, which is affected by the magnetic attraction of the magnet, may be provided on the other one. The first storage unit 200 and the first cover 210 may have shapes similar to those of the second storage unit 300 and the second cover 310 corresponding thereto, and thus a repeated description thereof is omitted herein.

Although the exemplary embodiments have been illustrated and described as above, of course, it will be apparent to those skilled in the art that the embodiments are provided to assist understanding of the present invention and the present invention is not limited to the above described particular embodiments, and various modifications and variations can be made in the present invention without departing from the spirit or scope of the present invention, and the modifications and variations should not be understood individually from the viewpoint or scope of the present invention.

MODE FOR THE INVENTION

As described above, a related description has been sufficiently made in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet;

a storage compartment provided in the cabinet to form a single space in which a storage item is stored;

a single door for opening or closing the space formed by the storage compartment;

a first cold air supply duct and a second cold air supply duct provided respectively on left and right sides of the single storage compartment, the first cold air supply duct and the second cold air supply duct supplying different amounts of cold air; and a storage unit for being pushed into or pulled from the storage compartment in a front-and-rear direction along with the door, the storage unit includes:

a first storage unit provided on the left side;

a second storage unit provided on the right side;

an insulator located between the first storage unit and the second storage unit for separating the first storage unit and the second storage unit from each other;

a first cover for opening or closing an opening formed in an upper side of the first storage unit; and a second cover for opening or closing an opening formed in an upper side of the second storage unit, the second cover being movable separately from the first cover, wherein the first storage unit and the second storage unit are maintained at different temperatures.

2. The refrigerator according to claim 1, wherein the storage compartment defines therein the single space, to which the cold air supplied from the first cold air supply duct and the second cold air supply duct moves.

3. The refrigerator according to claim 1, wherein the insulator has a greater thickness than a thickness of a wall of the first storage unit or the second storage unit.

4. The refrigerator according to claim 1, wherein the storage compartment includes an insulating partition located below the insulator.

5. The refrigerator according to claim 1, wherein the storage compartment includes a gasket located above the insulator.

6. The refrigerator according to claim 1, wherein the insulator is provided with a first protruding piece on a surface thereof facing the door, and wherein the first protruding piece extends toward the door so as to prevent movement of air between the left side and the right side within the storage compartment.

7. The refrigerator according to claim 1, wherein the insulator is provided with a second protruding piece on a surface thereof facing an inside of the storage compartment, and wherein the second protruding piece extends toward the inside of the storage compartment so as to prevent movement of air between the left side and the right side within the storage compartment.

8. The refrigerator according to claim 1, wherein the first cold air supply duct and the second cold air supply duct are located on an upper side of the storage compartment so as to discharge the cold air downward.

9. The refrigerator according to claim 1, wherein the storage compartment is provided in a rear surface thereof with a discharge opening for discharging air inside the storage compartment to an outside.

10. The refrigerator according to claim 9, wherein the discharge opening is located at a center in a left-and-right length of the rear surface.

11. The refrigerator according to claim 1, wherein the storage compartment includes a guide rib formed on a bottom surface thereof so as to extend a long length in a front-and-rear direction of the storage compartment.

12. The refrigerator according to claim 1, wherein the storage compartment is provided in a ceiling wall thereof with a through-hole, wherein the storage compartment includes a gasket located above the insulator, and wherein the storage compartment is provided on an exterior of the ceiling wall with a fixing member that fixes the gasket through the through-hole.

13. The refrigerator according to claim 1, wherein the door and the first storage unit define a first space therebetween so that the cold air discharged from the first cold air supply duct passes through the first space.

14. The refrigerator according to claim 1, wherein the door and the second storage unit define a second space therebetween so that the cold air discharged from the second cold air supply duct passes through the second space.

15. The refrigerator according to claim 1, wherein the first storage unit and the second storage unit are located so as to be spaced apart from a bottom surface of the storage compartment.

16. The refrigerator according to claim 1, wherein the storage compartment is provided in a bottom thereof with a first heater located below the first storage unit and a second heater located below the second storage unit.

17. The refrigerator according to claim 1, wherein the door includes a front portion located at a front side of the cabinet, and an upper surface portion horizontally extending from one end of the front portion, and wherein the upper surface portion is provided with a display unit for providing information related to the storage compartment.

18. The refrigerator according to claim 1, wherein any one of the first storage unit and the first cover includes a magnet, and a remaining one thereof includes a member affected by magnetic attraction of the magnet.

19. The refrigerator according to claim 1, wherein the first cold air supply duct and the second cold air supply duct are connected to a duct unit, into which cold air is introduced from an evaporator, and wherein the duct unit is provided with a first damper and a second damper, which selectively open or close the first cold air supply duct and the second cold air supply duct respectively.

20. The refrigerator according to claim 1, further comprising:

a first heater located below the first storage unit; and a second heater located below the second storage unit, wherein, when a difference between set temperatures of the first storage unit and the second storage unit is increased, an operation factor of the heater that is operated is increased compared to a case where the set temperatures of the first storage unit and the second storage unit are the same.

* * * * *